US006412318B1

(12) United States Patent
Shen

(10) Patent No.: US 6,412,318 B1
(45) Date of Patent: Jul. 2, 2002

(54) ELECTRIC CYLINDRICAL LOCK UNLOCKABLE BY A KEY

(76) Inventor: Mu-Lin Shen, No. 32, Lane 76, Fu-An Road, Sec. 5, Tainan (TW)

( * ) Notice: Subject to any disclaimer, the term of this patent is extended or adjusted under 35 U.S.C. 154(b) by 0 days.

(21) Appl. No.: 09/886,508

(22) Filed: Jun. 21, 2001

(51) Int. Cl.[7] ..... E05B 13/10

(52) U.S. Cl. ..... 70/217; 70/224; 70/278.7; 70/279.1; 70/283

(58) Field of Search ..... 70/224, 215–217, 70/279.1, 278.7, 277, 278.2, 278.3, 283, 283.1

(56) References Cited

U.S. PATENT DOCUMENTS 2,998,274 A * 8/1961 Russell ..... 70/216
3,894,417 A * 7/1975 Taniyauna ..... 70/156
4,736,970 A * 4/1988 McGourty et al. ..... 70/283 X
5,018,375 A * 5/1991 Tully ..... 70/224 X
5,447,047 A * 9/1995 Lin ..... 70/276 X
5,694,798 A * 12/1997 Nunez et al. ..... 70/283
5,904,232 A * 5/1999 Shen ..... 70/223 X
5,960,656 A * 10/1999 Yao ..... 70/223 X
6,038,896 A * 3/2000 Chamberlain et al. ..... 70/279.1
6,189,351 B1 * 2/2001 Eagan et al. ..... 70/472

* cited by examiner

*Primary Examiner*—LLoyd A. Gall
(74) *Attorney, Agent, or Firm*—Alan Kamrath; Rider, Bennett, Egan & Arundel, LLP

(57) ABSTRACT

An electric cylindrical lock comprises a chassis, an inner spindle, an inner handle, a latch assembly, an outer handle, and an outer spindle. A tubular seat is mounted around an end of the outer spindle and includes a positioning groove aligned with a slot of the outer spindle. When a solenoid mounted in the tubular seat is energized, a protrusion of a locking plate in the tubular seat is engaged in the positioning groove of the tubular seat to thereby prevent rotation of the outer handle. When the solenoid is inoperable, the lock cylinder is turnable by a key to cause longitudinal movement of the locking plate, thereby disengaging the protrusion of the locking plate from the positioning groove of the tubular seat.

7 Claims, 7 Drawing Sheets

ELECTRIC CYLINDRICAL LOCK UNLOCKABLE BY A KEY

BACKGROUND OF THE INVENTION

1. Field of the Invention

The present invention relates to an electric cylindrical lock that can be unlocked by a key when a solenoid of the electric cylindrical lock malfunctions or when electricity service is unavailable.

2. Description of the Related Art

Cylindrical locks are convenient to handicapped people, but the hand-handicapped users still suffer from inserting a flat key into the keyhole of a cylindrical lock. Electric cylindrical locks are thus proposed to eliminate this drawback, but they bring other problems. Particularly, the door cannot be opened when the electricity is out of service or a solenoid of the cylindrical lock malfunctions.

SUMMARY OF THE INVENTION

It is, therefore, the primary object of the present invention to provide an electric cylindrical lock that can be unlocked by a key when a solenoid of the electric cylindrical lock malfunctions or when electricity service is unavailable.

An electric cylindrical lock in accordance with the present invention comprises:

a chassis;

an inner spindle attached to the chassis;

an inner handle operably connected to the inner spindle;

a latch assembly attached to the chassis and including a latch, the inner handle and the inner spindle being so arranged that rotation of the inner handle causes retraction of the latch;

an outer spindle attached to the chassis and having a first end and a second end, the outer spindle further including a slot;

an outer handle operably connected to the first end of the outer spindle, the outer handle and the outer spindle being so arranged that rotation of one of the outer spindle and the outer handle causes retraction of the latch;

a lock cylinder mounted in the outer handle;

a tubular seat mounted around the second end of the outer spindle and including a positioning groove aligned with the slot of the outer spindle;

a sleeve mounted in the outer spindle and including an end operably connected to the lock cylinder such that the sleeve rotates in the outer spindle when the lock cylinder is turned;

a pressing plate mounted in the outer spindle and including a first end and a second end, the first end of the pressing plate being operably connected to the sleeve such that the pressing plate moves along a longitudinal direction of the outer spindle when the sleeve rotates in response to turning of the lock cylinder;

a solenoid mounted in the tubular seat and including a first end and a second end, the first end of the solenoid being connected to the second end of the pressing plate to move therewith;

a locking plate mounted in the tubular seat, the locking plate including a protrusion releasably engaged in the positioning groove of the tubular seat; and a spring attached between the second end of the solenoid and the locking plate;

wherein when the solenoid is energized, the electric cylindrical lock is in a locked state in which the protrusion of the locking plate is engaged in the positioning groove of the tubular seat;

wherein when the solenoid is de-energized, the locking plate is moved along the longitudinal direction of the outer spindle such that the protrusion of the locking plate is disengaged from the positioning groove of the tubular seat, thereby allowing unlatching by means of turning one of the inner handle and the outer handle; and wherein when the solenoid is inoperable, the lock cylinder is turnable by a key to cause longitudinal movements of the solenoid, the pressing plate, and the sleeve which. in turn, causes the locking plate to move along the longitudinal direction of the outer spindle such that the protrusion of the locking plate is disengaged from the positioning groove of the tubular seat, thereby allowing unlatching by means of turning one of the inner handle and the outer handle.

The first end of the sleeve includes a substantially 8-shape opening and the lock cylinder includes a tailpiece engaged in the 8-shape opening. The sleeve includes an arcuate slot in a periphery thereof. The pressing plate includes a stem extending from a side thereof. The stem is received in the sleeve and includes a fixing hole. A pin extends through the arcuate slot and has an end anchored in the fixing hole. The sleeve further includes a protrusion that is slidably received in the slot of the outer spindle. The solenoid includes a hole and the locking plate includes a through-hole. A positioning rod extends through the through-hole of the locking plate, the spring, and secured in the hole of the solenoid to move therewith. The positioning rod includes an enlarged head to prevent excessive movement of the locking plate.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
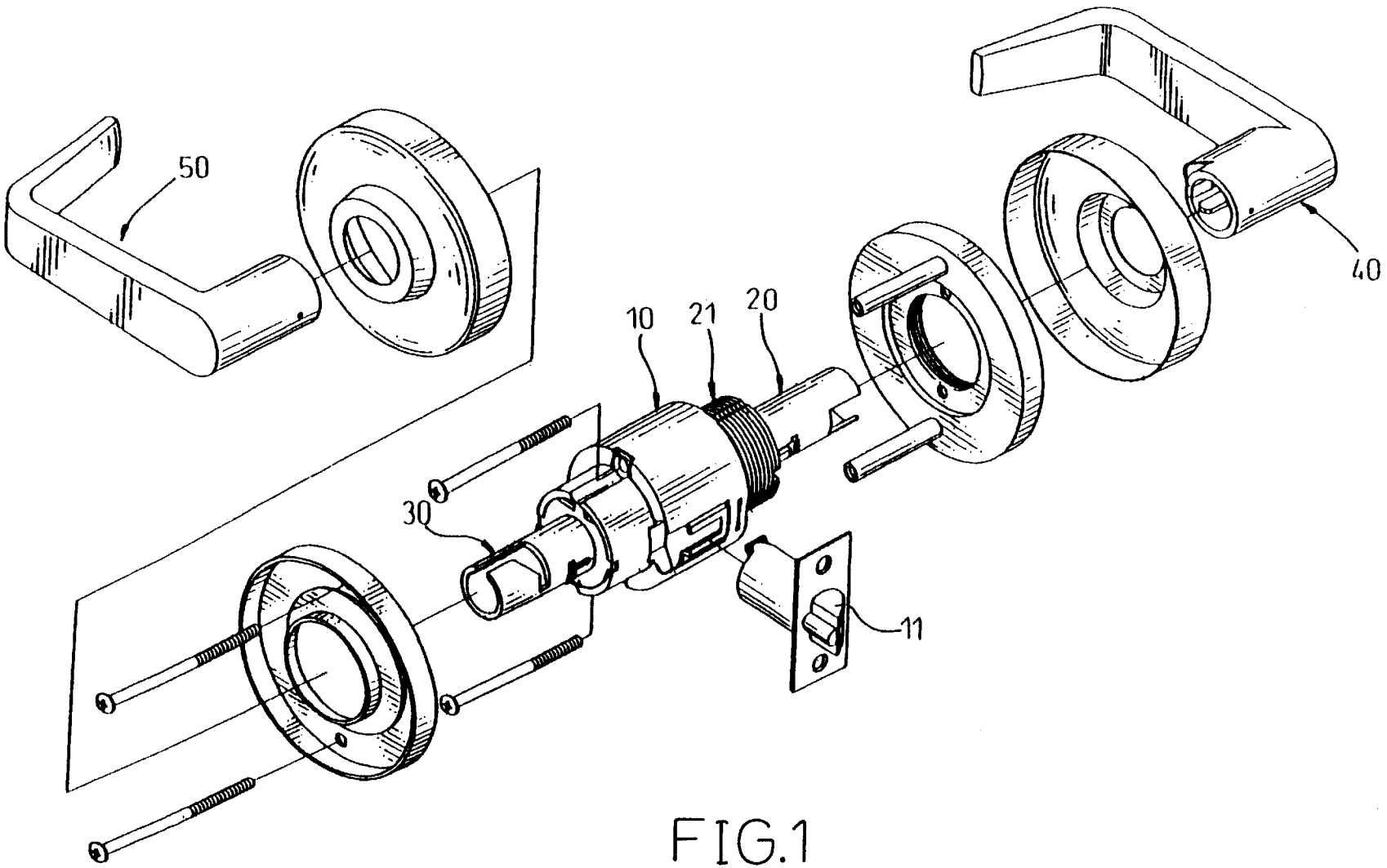
FIG. 1 is an exploded perspective view of an electric cylindrical lock in accordance with the present invention.

Referring to FIG. 1, an electric cylindrical lock in accordance with the present invention generally includes a chassis 10, a latch assembly attached to the chassis and including a latch 11, an inner handle assembly consisting of an inner handle 50 and an inner spindle 30, and an outer handle assembly consisting of an outer handle 40 and an outer spindle 20. The inner spindle 30 is attached to the chassis 10 and the inner handle 50 is operably connected to the inner spindle 30 in a conventional manner. Similarly, the outer spindle 20 is attached to the chassis 10 and the outer handle 40 is operably connected to the outer spindle 20 in a conventional manner. When the electric cylindrical lock is in an unlocked state, rotation of either handle 40, 50 causes retraction of the latch 11 to thereby allow opening of a door (not shown) to which the electric cylindrical lock is mounted.

Figure 2:
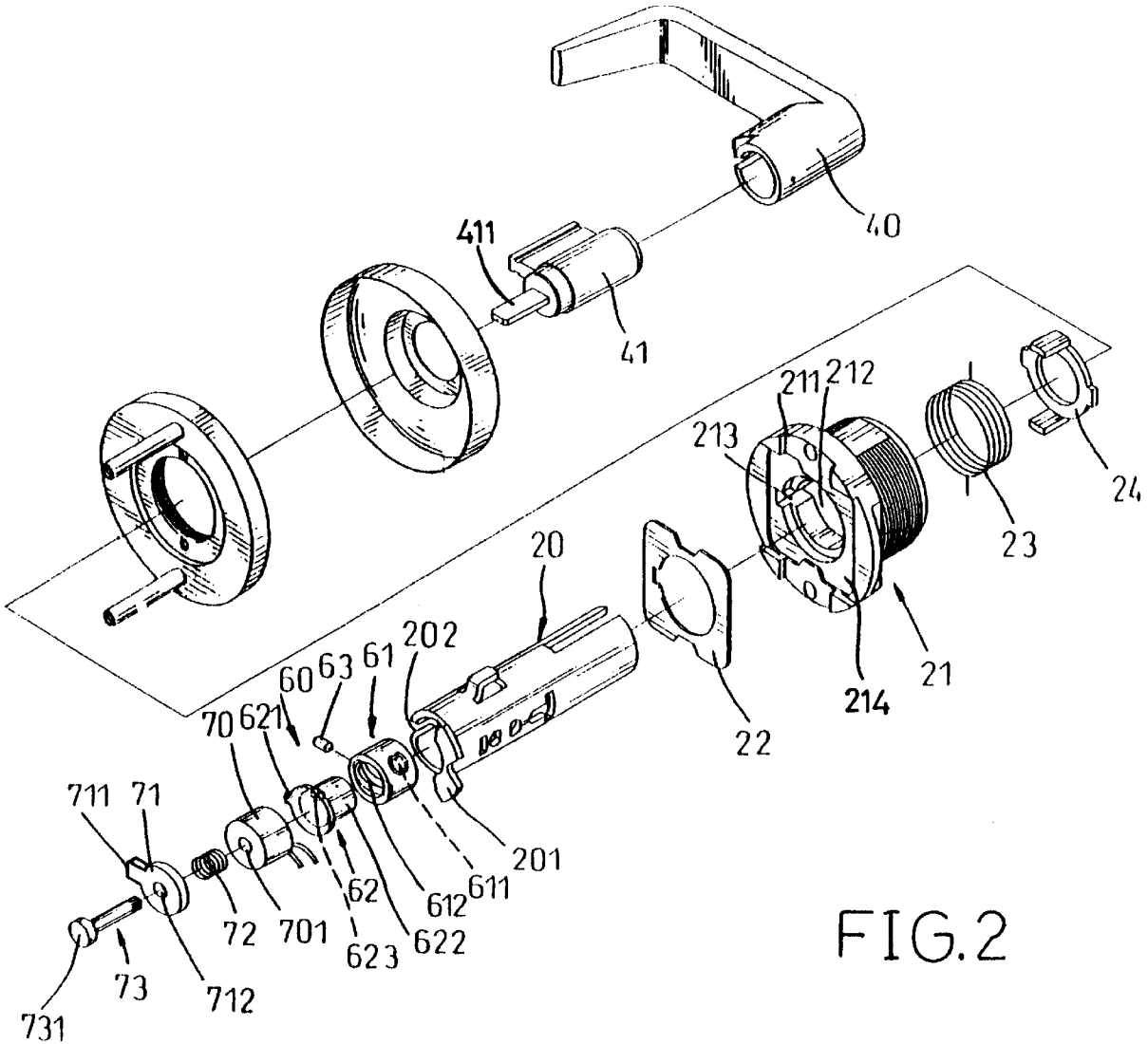
FIG. 2 is an exploded perspective view of an outer handle assembly of the electric cylindrical lock in accordance with the present invention.

Still referring to FIG. 1 and further to FIG. 2, a tubular seat 21 is mounted around the outer spindle 20 and includes an end 211 having a compartment 212 and a recessed portion 214 in an end face thereof. The end 211 further includes a positioning groove 213 in an inner periphery thereof. A positioning plate 22 is mounted in the recessed portion 214. The outer spindle 20 is extended through the positioning plate 22 and the tubular seat 21 with a lug 201 of the outer spindle 20 bearing against an outer end face of the positioning plate 22 to thereby fix the positioning plate 22 in place. A torsion spring 23 and a positioning ring 24 are mounted to an outer side of the tubular seat 21. The outer spindle 20 includes a slot 202 opposed to the lug 201. An actuating device 60, a solenoid 70, and a locking plate 71 are mounted into an inner end of the outer spindle 20 in sequence.

Figure 3:
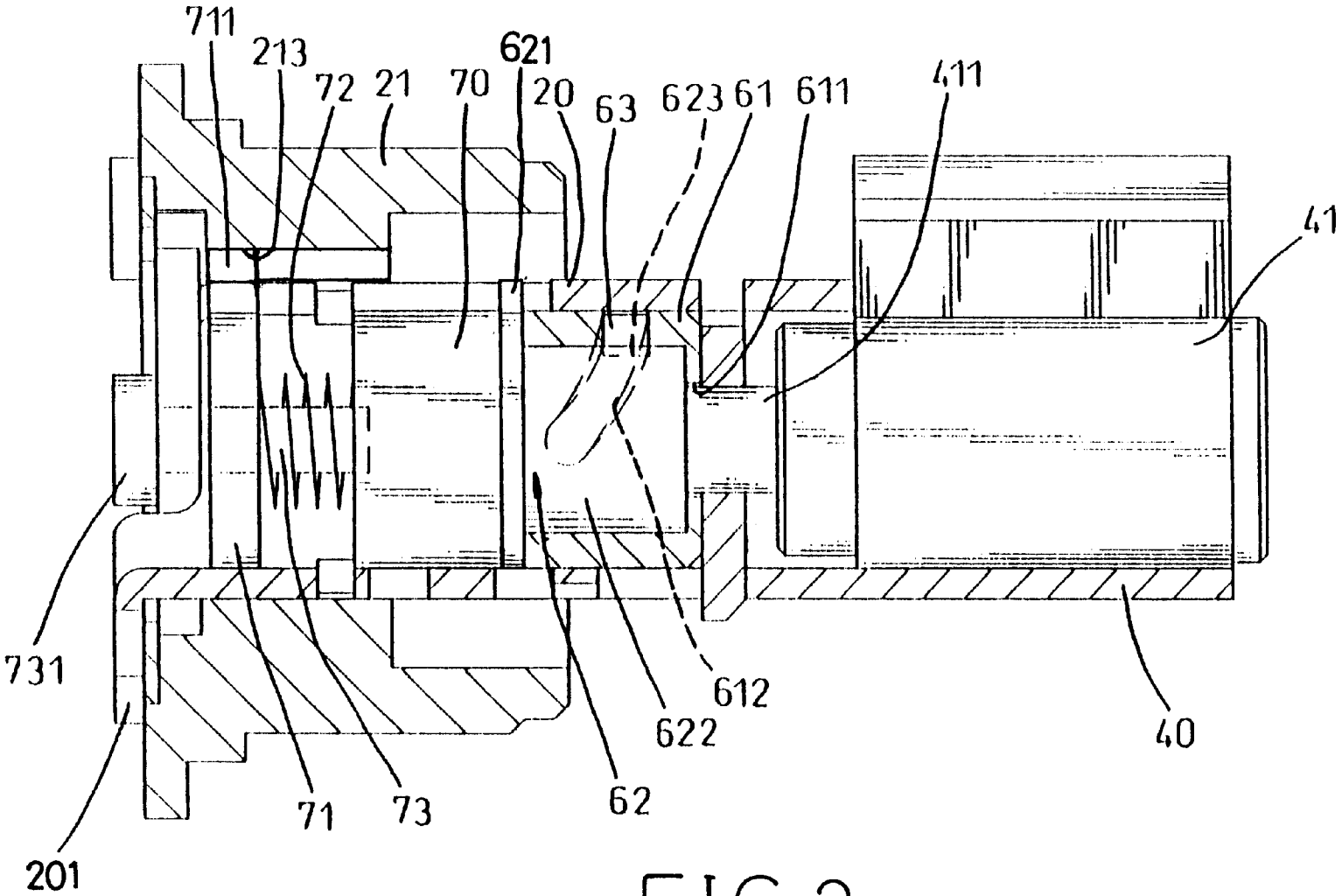
FIG. 3 is a sectional view of the outer handle assembly in FIG. 2.

Referring to FIGS. 2 and 3, the actuating device 60 includes a sleeve 61 and a pressing plate 62. The sleeve 61 includes a substantially 8-shape opening 611 in an end thereof that faces the outer handle 40. The sleeve 61 further includes an arcuate slot 612 in a periphery thereof. The pressing plate 62 includes a protrusion 621 projecting radially outward from a periphery thereof and a stem 622 extending longitudinally from a side thereof. A fixing hole 623 is defined in a periphery of the stem 622. A pin 63 is extended through the arcuate slot 612 of the sleeve 61 and anchored in the fixing hole 623 of the stem 622 that is received in the sleeve 61. Thus, when the sleeve 61 is turned, the pin 63 and the sleeve 61 move relative to each other under guidance by the arcuate slot 612 of the sleeve 61, thereby moving the pressing plate 62 along a longitudinal direction.

Electricity is supplied to the solenoid 70 by wires (not labeled) in a conventional manner. The solenoid 70 includes a hole 701. A spring 72 is attached between the solenoid 70 and the locking plate 71 that has a protrusion 711 extending along a direction parallel to the extending direction of the protrusion 621 of the pressing plate 62. A positioning rod 73 having an enlarged head 731 is extended through a through-hole 712 in the locking plate 71 and the spring 72 and secured in the hole 701 of the solenoid 70. The protrusion 621 of the pressing plate 62 and the protrusion 711 of the locking plate 71 are both located in the slot 202 of the outer spindle 20 when the actuating device 60, the solenoid 70 the spring 72, and the locking plate 71 are mounted inside the outer spindle 20.

Figure 4:
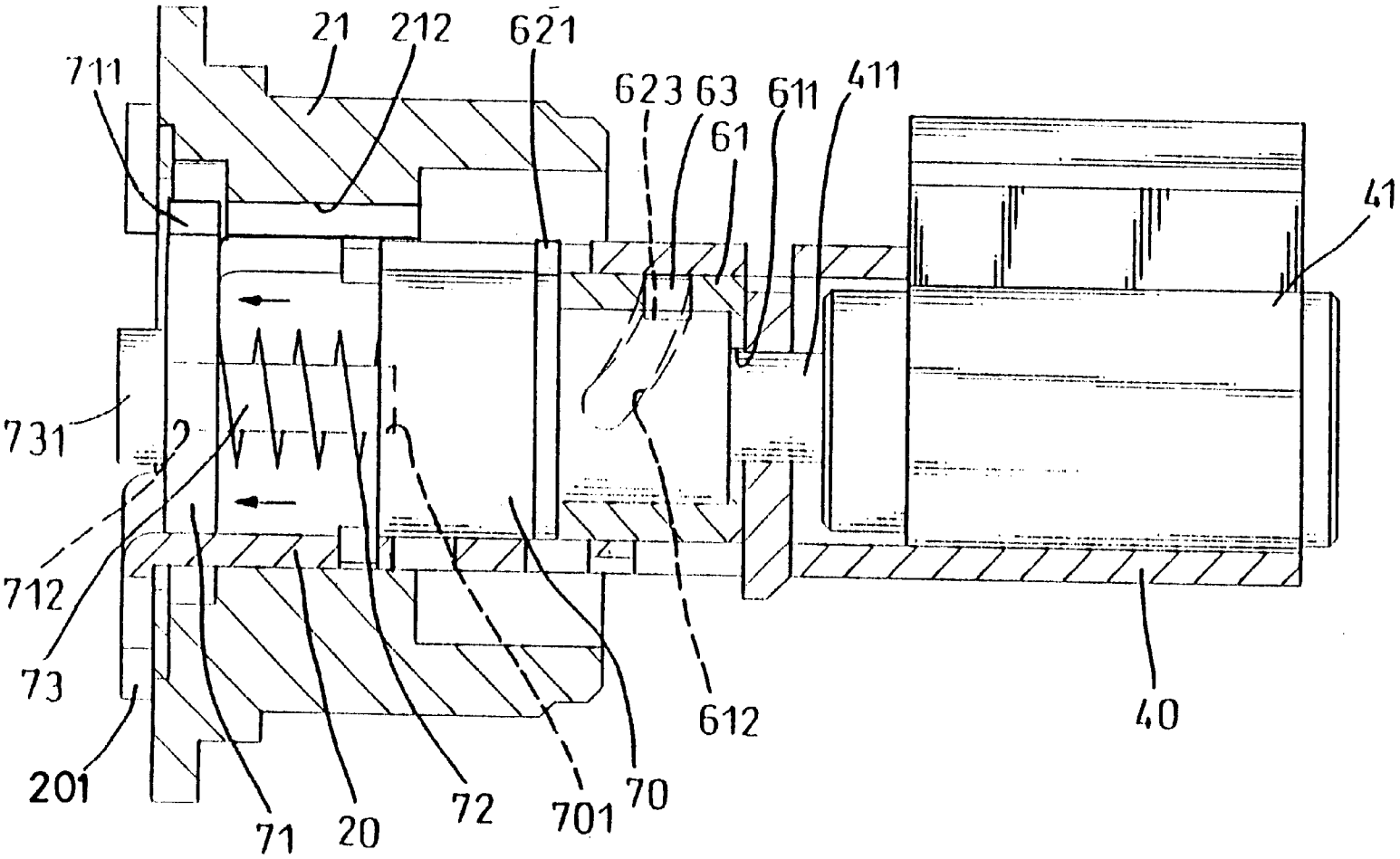
FIG. 4 is a sectional view similar to FIG. 3, illustrating normal unlocking by a solenoid of the electric cylindrical lock in accordance with the present invention.

In normal use, the locking plate 71 is controlled by the solenoid 70. The locking plate 71 in FIG. 3 is in a locked state in which the solenoid 70 is energized and thus generates a magnetic force. The protrusion 711 of the locking plate 71 is engaged in the positioning groove 213 of the outer seat 21 under the action of the magnetic force that attracts the locking plate 71, thereby preventing rotation of the outer spindle 20. Thus, the outer handle 40 cannot be turned. When unlocking is required, the user may use a magnetized card or other electric switch to de-energize the solenoid 70. The magnetic force vanishes and the locking plate 71 is moved inward under the action of the spring 72 until the locking plate 71 is stopped by the enlarged head 731 of the positioning rod 73, best shown in FIG. 4. The protrusion 711 of the locking plate 71 is thus disengaged from the positioning groove 213 of the seat 21 to thereby allow rotational movement of the outer spindle 20 and the outer handle 40.

Figure 5:
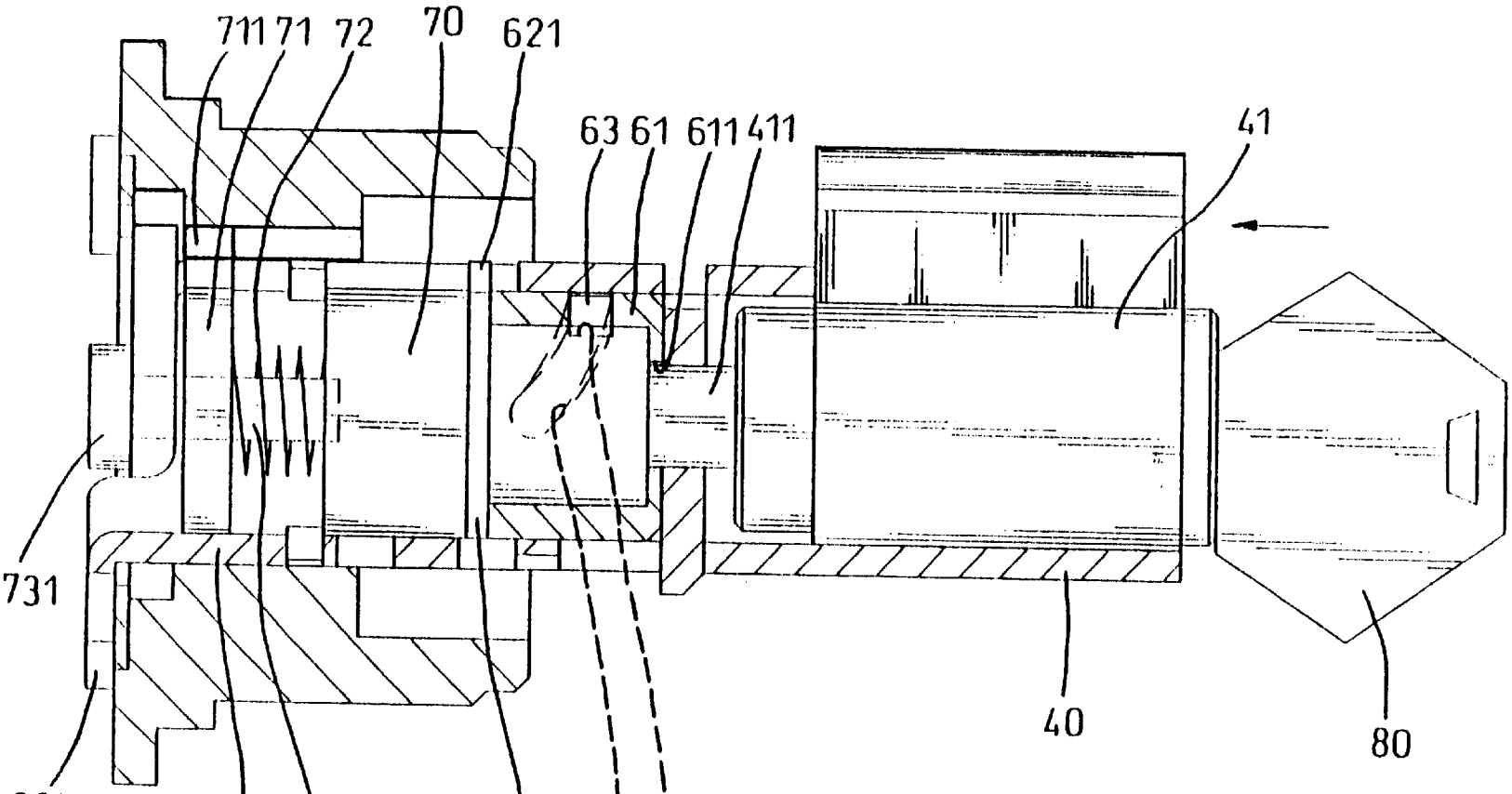
FIG. 5 is a sectional view similar to FIG. 3, wherein a key is used for unlocking.
Figure 6:
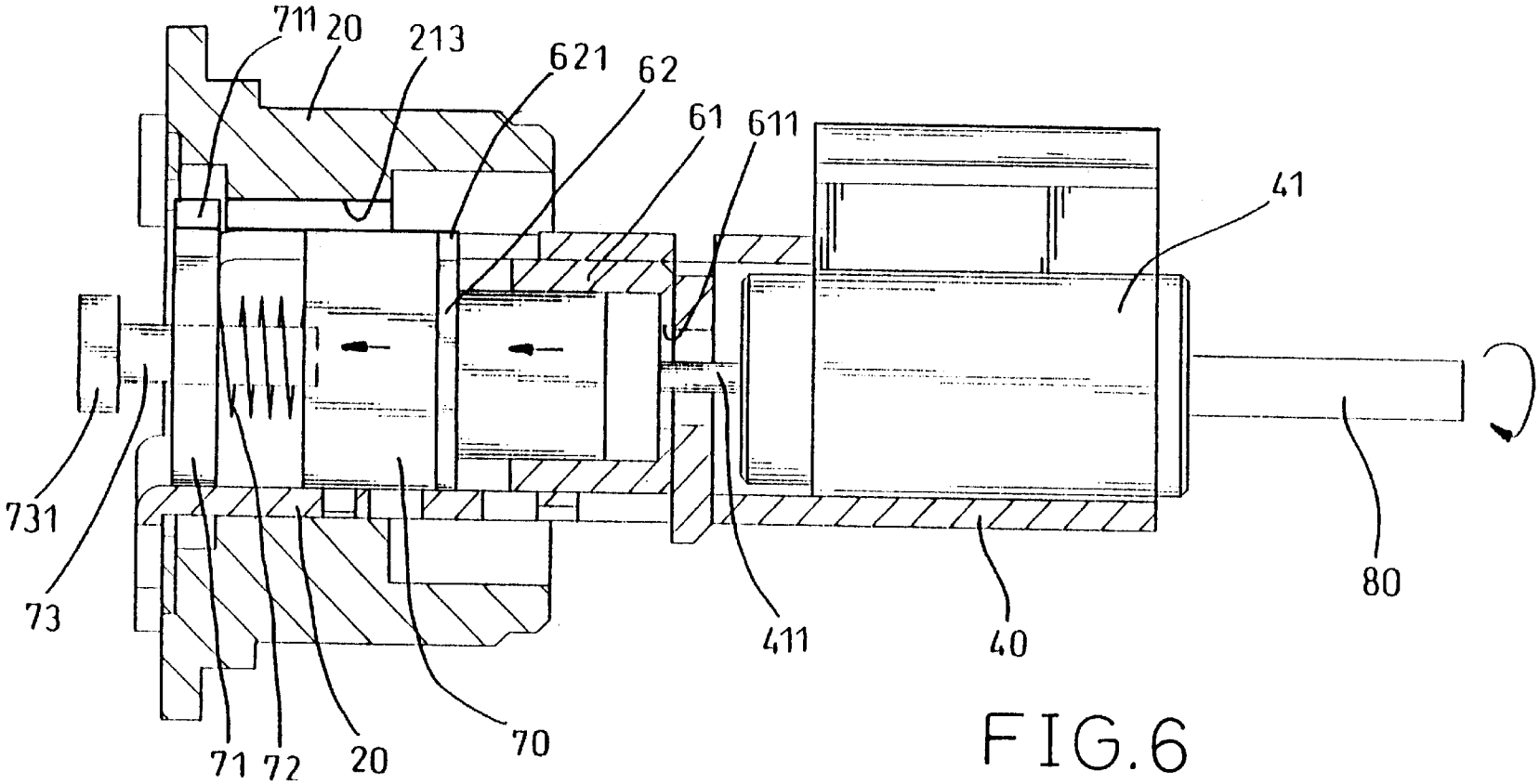
FIG. 6 is a sectional view similar to FIG. 5, illustrating unlocking operation by the key.

In a case that the solenoid 70 is inoperable, such as electricity service is unavailable or the solenoid 70 malfunctions as a result of damage of electric elements, the electric cylindrical lock is in a locked state shown in FIG. 3. In this case. referring to FIG. 5. a key 80 may be inserted into the lock cylinder 41 and then rotated through an angle to a position shown in FIG. 6. A tailpiece 411 of the lock cylinder 41 is turned, which, in turn, causes rotation of the sleeve 61. The pin 63 and the sleeve 61 move relative to each other under the guidance by the arcuate slot 612. As a result, the pressing plate 62 moves longitudinally inward away from the sleeve 61 to cause synchronous longitudinal movements of the solenoid 70, the spring 72, and the locking plate 71, best shown in FIG. 6. The protrusion 711 of the locking plate 71 is thus disengaged from the positioning groove 213 of the seat 21 to thereby allow rotational movement of the outer spindle 20 and the outer handle 40.

Figure 7:
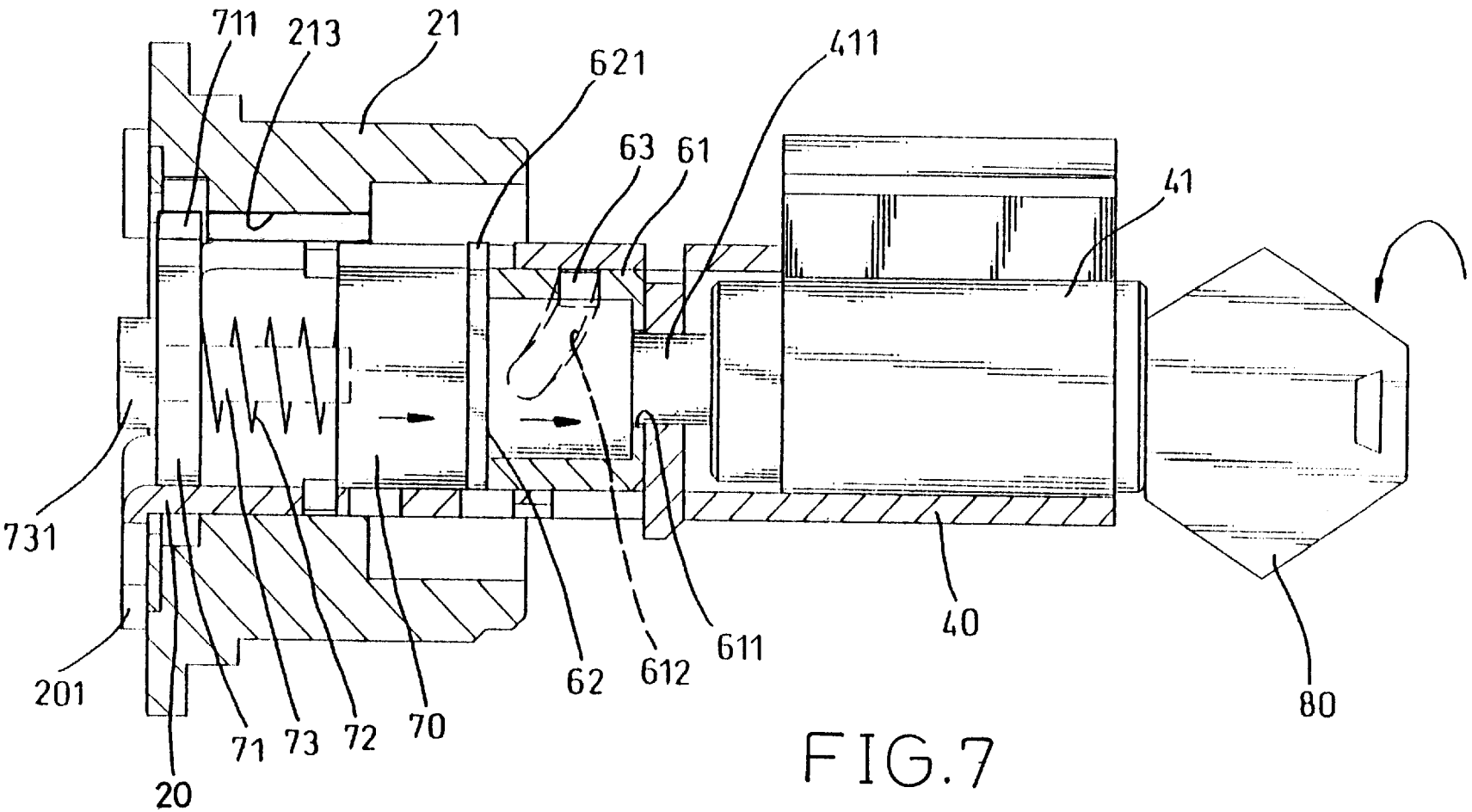
FIG. 7 is a sectional view similar to FIG. 6, wherein the key is turned in a reversed direction to restore unlocking operation by the solenoid.

When the solenoid 70 can be operated again, the key 80 is turned to drive the lock cylinder 41 in a reverse direction, thereby rotating the sleeve 61 in the reverse direction. The pressing plate 62 retracts into the sleeve 61, as shown in FIG. 7. Thus, the solenoid 70, the spring 72, and the locking plate 71 will be moved back to their locking positions shown in FIG. 3. The solenoid 70 and the pressing plate 62 may be secured together by bonding or any other suitable means.

According to the above description, it is appreciated that the electric cylindrical lock in accordance with the present invention can be unlocked by a key when the solenoid of the electric cylindrical lock malfunctions or when electricity service is unavailable. This may even save lives in an emergency.

Although the invention has been explained in relation to its preferred embodiment. it is to be understood that many other possible modifications and variations can be made without departing from the scope of the invention as hereinafter claimed.

What is claimed is:

1. An electric cylindrical lock comprising:

a chassis;

an inner spindle attached to the chassis;

an inner handle operably connected to the inner spindle;

a latch assembly attached to the chassis and including a latch, the inner handle and the inner spindle being so arranged that rotation of the inner handle causes retraction of the latch;

an outer spindle attached to the chassis and having a first end and a second end, the outer spindle further including a slot;

an outer handle operably connected to the first end of the outer spindle, the outer handle and the outer spindle being so arranged that rotation of one of the outer spindle and the outer handle causes retraction of the latch;

a lock cylinder mounted in the outer handle;

a tubular seat mounted around the second end of the outer spindle and including a positioning groove aligned with the slot of the outer spindle;

a sleeve mounted in the outer spindle and including an end operably connected to the lock cylinder such that the sleeve rotates in the outer spindle when the lock cylinder is turned;

a pressing plate mounted in the outer spindle and including a first end and a second end, the first end of the pressing plate being operably connected to the sleeve such that the pressing plate moves along a longitudinal direction of the outer spindle when the sleeve rotates in response to turning of the lock cylinder;

a solenoid mounted in the tubular seat and including a first end and a second end, the first end of the solenoid being connected to the second end of the pressing plate to move therewith;

a locking plate mounted in the tubular seat, the locking plate including a protrusion releasably engaged in the positioning groove of the tubular seat; and a spring attached between the second end of the solenoid and the locking plate;

wherein when the solenoid is energized, the electric cylindrical lock is in a locked state in which the protrusion of the locking plate is engaged in the positioning groove of the tubular seat;

wherein when the solenoid is de-energized, the locking plate is moved along the longitudinal direction of the outer spindle such that the protrusion of the locking plate is disengaged from the positioning groove of the tubular seat, thereby allowing unlatching by means of turning one of the inner handle and the outer handle; and wherein when the solenoid is inoperable, the lock cylinder is turnable by a key to cause longitudinal movements of the solenoid, the pressing plate, and the sleeve, which, in turn, causes the locking plate to move along the longitudinal direction of the outer spindle such that the protrusion of the locking plate is disengaged from the positioning groove of the tubular seat, thereby allowing unlatching by means of turning one of the inner handle and the outer handle.

2. The electric cylindrical lock as claimed in claim 1, wherein the first end of the sleeve includes a substantially 8-shape opening, the lock cylinder including a tailpiece engaged in the 8-shape opening.

3. The electric cylindrical lock as claimed in claim 1, wherein the sleeve includes an arcuate slot in a periphery thereof, the pressing plate including a stem extending from a side thereof, the stem being received in the sleeve and including a fixing hole, further comprising a pin extending through the arcuate slot and having an end anchored in the fixing hole.

4. The electric cylindrical lock as claimed in claim 3, wherein the pressing plate further includes a protrusion that is slidably received in the slot of the outer spindle.

5. The electric cylindrical lock as claimed in claim 1, wherein the solenoid includes a hole and the locking plate includes a through-hole, further comprising a positioning rod extending through the through-hole of the locking plate, the spring, and secured in the hole of the solenoid to move therewith, the positioning rod including an enlarged head to stop the locking plate.

6. The electric cylindrical lock as claimed in claim 3, wherein the solenoid includes a hole and the locking plate includes a through-hole, further comprising a positioning rod extending through the through-hole of the locking plate, the spring, and secured in the hole of the solenoid to move therewith, the positioning rod including an enlarged head to prevent excessive movement of the locking plate.

7. The electric cylindrical lock as claimed in claim 4, wherein the solenoid includes a hole and the locking plate includes a through-hole, further comprising a positioning rod extending through the through-hole of the locking plate, the spring, and secured in the hole of the solenoid to move therewith, the positioning rod including an enlarged head to prevent excessive movement of the locking plate.

* * * * *